United States Patent [19]

Jones

[11] Patent Number: 5,016,380

[45] Date of Patent: May 21, 1991

[54] WEAPON APPARATUS

[76] Inventor: Robert B. Jones, 7119 Ohio River Blvd., Pittsburgh, Pa. 15202

[21] Appl. No.: 477,428

[22] Filed: Feb. 9, 1990

[51] Int. Cl.[5] ..... F41C 27/00; B25G 1/08

[52] U.S. Cl. ..... 42/90; 81/177.4; 81/490

[58] Field of Search ..... 42/90; 81/3.05, 177.4, 81/490

[56] References Cited

U.S. PATENT DOCUMENTS

| | | | |
|---|---|---|---|
| 2,363,520 | 11/1944 | Fish | 81/3.05 |
| 2,616,109 | 11/1952 | Gardner | 42/90 |
| 2,744,275 | 5/1956 | Geltner | 42/90 |
| 4,327,515 | 5/1982 | Kuryn | 42/90 |
| 4,407,086 | 10/1983 | Hasselmann | 42/90 |
| 4,589,220 | 5/1986 | Lofland | 42/90 |
| 4,607,446 | 8/1986 | Scheuring | 42/90 |
| 4,817,321 | 4/1989 | Clement | 42/90 |
| 4,843,747 | 7/1989 | Echeberria | 42/90 |

*Primary Examiner*—Charles T. Jordan
*Attorney, Agent, or Firm*—Lawrence G. Zurawsky; Thomas F. Shanahan

[57] ABSTRACT

A combination tool for using, repairing and maintaining muzzle loading firearms includes a ball starter tool member connected to an elongated body member which provides the land and groove setting rod of the ball starter and further provides a housing and carrier for a plurality of additional tool members. The additional tool members include at least a plurality of screwdrivers, a flash hole nipple probe, a plurality of whistle signaling devices, a plurality of powder measures and a plurality of bar or pry members.

14 Claims, 2 Drawing Sheets

WEAPON APPARATUS

BACKGROUND OF THE INVENTION

1. Field of the Invention

This invention relates to a tool for use in loading, maintaining, repairing and otherwise using weapons, in particular muzzle loading guns, which are loaded through the barrel of the gun.

2. Description of the Prior Art

In the prior art, a powder charge is first poured down the barrel into the muzzle of the gun. Next a projectile, typically a round ball, musket ball, minnie ball, or bullet, is thrust through the barrel into the muzzle. Generally, the ball is wrapped in a greased cloth patch, the ball is tamped partially into the gun barrel, using a ball starter, the patch is trimmed, the land and groove setting rod is used to tamp the ball farther into the barrel, and the ball is thereafter tamped down tightly onto the powder using a ram rod. The gun is then primed and discharged.

In recent years, interest in sporting use of muzzle loading guns has increased. Proper use, loading techniques, adjustment, maintenance and repair of the weapons require that the sportsman carry numerous tools including, at least, a ball and bullet starter; a land and groove setting rod; various powder measures, large and small screwdrivers, a flash hole pick, a nipple port cleaner, various whistles or other signaling devices, a non-marring hammer for removing and replacing pins and connectors, a wedge puller, cloth patches, rod accessories, flints, a nipple wrench, and other items such as a compass, a writing implement, and so forth. Generally, the weight of the aggregation of tools and implements required in the prior art exceeds two pounds.

An example of muzzle loading weapon tools known in the prior art is described in U.S. Pat. No. 4,407,086 to Hasselmann, which describes a muzzle loading ramrod with a ball starter at one end, having the opposite end of the ram rod threaded to engage a screw-jag tool for use in removing a musket ball lodged in the breech of the weapon. That patent does not disclose the concept or structure of the compact, combination apparatus of the present invention. In fact, the Hasselmann patent teaches the practice of the sportsman carrying several screw-jag tools separately with the other separately carried auxiliary equipment carried by the sportsman for use with the weapon. The Hasselmann patent does not describe any solution for the problems encountered in carrying a multiplicity of small, easily lost, cumbersome tools and equipment pieces for the weapon, which problem is resolved by the apparatus of this invention.

U.S. Pat. No. 2,363,520 to Fish describes a combination tool for cleaning the chamber of a firearm, disassembling the firearm, and removing a ruptured cartridge casing from the firearm chamber. The combination tool includes a brush or scouring implement, a cleaning rod, a screwdriver, a drift pin, and a cartridge extraction tool. The Fish patent describes a highly specialized combination apparatus for use with breech loading firearms, but does not provide any teaching related to a combination tool for use with muzzle loading weapons as disclosed in the present invention.

U.S. Pat. No. 4,817,321 to Clement discloses a combination tool for use with cap lock muzzle loading firearms, which tool includes a powder measuring device, a nipple wrench, a cleaning rod for the nipple port, a combination cap holder and spare nipple receptacle, and a decapper device. That patent does not disclose or suggest a tool combining a ball starter assembly housing a plurality of additional weapon tools and does not suggest inclusion of all the weapon tools included in the apparatus of the present invention.

U.S. Pat. No. 4,843,747 to Echeberria discloses a tool for muzzle loading weapons including a nipple wrench, a nipple port cleaning pin, extra nipples, a ram rod, and a screwdriver. That patent does not disclose or suggest a muzzle loading weapon tool combining a ball starter assembly housing a plurality of other tools contained within the ball starter body in a compact, smooth housing forming the ball starter and land and groove setting rod assembly which are included in the combination of the present invention.

U.S. Pat. No. 4,589,220 to Lofland does not describe a combination tool such as that of the present invention, but does describe a carrying case for storing various items related to the use, repair and maintenance of muzzle loading firearms. The Lofland carrying case has receptacles for a container for gun powder, ball patches and balls, a loading funnel, a ball retrieving device, a patch retrieving device and a hole cleaner pick. Although Lofland indicates that a short starter (or ball starter) and the tools contained in his carrying kit are standard equipment with muzzle loading guns, the Lofland patent does not suggest or describe a combination tool such as the apparatus of this invention in which the ball starter or land and groove setting rod itself provides additional tools and tool functions and a carrying and storing receptacle for other tool members.

U.S. Pat. No. 4,135,322 to Tice, et al is exemplary of patents which describe a device for storing a single muzzle charge of powder, a single ball and a single percussion cap to facilitate rapid loading of the firearm. That patent, while similar in disclosure and teaching to some portions of the Lofland patent described above, does not suggest or describe the combination, multipurpose tool of this invention.

The prior art contains patents disclosing various types of screwdriver devices containing a plurality of screwdriver blades, each of which can be inserted in a chuck assembly included as part of the device. Such patents include U.S. Pat. No. 19,901 to Aiken; U.S. Pat. No. 4,463,788 to Corona, et al and U.S. Pat. No. 4,273,173 to Smith, et al. None of those patents suggests or describes either the concept, or specific apparatus or structure, for the combination of a weapon ball starter and land and groove setting rod with the individual, specifically required screwdrivers and other repair, maintenance and use tools included in the present invention. There is nothing in any of those patents to suggest or describe a tool for use with muzzle loading firearms.

OBJECTIVES OF THE INVENTION

It is an object of the present invention to provide a multi-purpose, combination tool for use with, and maintenance and repair of, muzzle loading firearms and weapons.

It is another object of this invention to provide a multi-purpose tool for use with a muzzle loading weapon, combining a ball starter apparatus with a land and groove setting rod, a flash hole and nipple cleaning probe, a wedge pin remover, screwdrivers, powder measures, whistle signaling devices and various pry devices.

It is a further object of the present invention to provide an integrated combination tool which is light in weight and compact in dimension and size, which can be carried as a single unit.

With those objects and other objects under consideration, as will be apparent to those skilled in the art, this invention resides in the combination of parts set forth in the specification and drawings and covered by the claims appended hereto.

SUMMARY OF THE INVENTION

In general, this invention comprises a multi-purpose, combination tool for use in the operation, maintenance and repair of muzzle loading firearms and weapons. This invention comprises an integrated combination of muzzle loading firearm tools comprising a ball starter with land and groove setting rod having hollow or elongated body members each of which contains one or more of a plurality of tools selected from a group of screwdrivers, cleaning probes for the flash hole and nipple. In a preferred embodiment, the hollow body members also provide individual powder measuring devices and whistle signal devices. In a further preferred embodiment, a top edge of one or more of the hollow body members provides a wrench, bar, pry or wedge tool for removal of the wedge pin from the firearm. In a still further preferred embodiment of this invention, the connecting member securing the ball starter grip to an end of the tool body consists of a hollow connector which also provides an additional whistle signal device.

DESCRIPTION OF THE PREFERRED EMBODIMENTS

Figure 1:
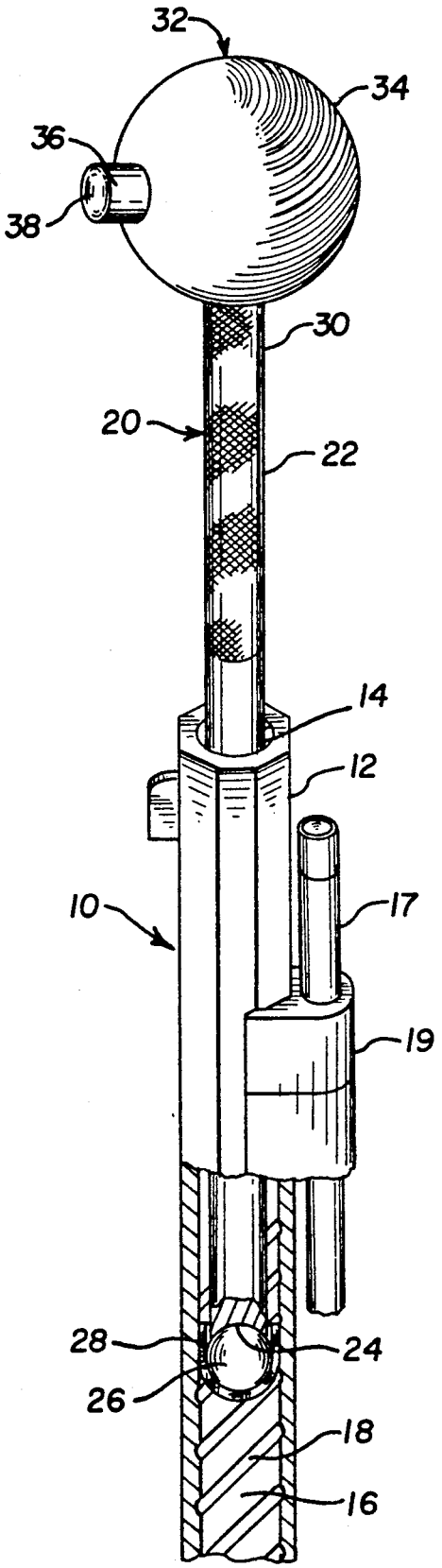
FIG. 1 is a perspective view, partially in cross section, of the combination tool of this invention inserted in the barrel of a muzzle loading firearm for positioning therein of a ball and patch.

Referring to FIG. 1, a muzzle loading firearm is referred to generally by reference numeral 10. As used in this specification and in the claims, the term "weapon" refers to and connotes all types of muzzle loading firearms including, but not limited to, both rifles and pistols, whether having rifled or unrifled barrels or bores, and whether functioning as pan fired, frizzen fired, or cap fired firearms.

As shown in FIG. 1, weapon 10 comprises barrel 12 having a central, longitudinal bore 14. Bore 14 is provided with rifling consisting of lands and grooves 18 formed in the surface of bore 14. A ram rod 17 is mounted in a receptacle 19 extending from and along a portion of barrel 12.

The multi-purpose combination tool of this invention is indicated generally by reference numeral 20 and is shown in FIG. 1 partially inserted in bore 14 of barrel 12 of weapon 10. The body 22 of tool 20 has an end surface 24 that is substantially concave in configuration to facilitate its engagement with the surface of a ball 26 in a manner that assures that contact between concave surface 24 of the tool will not cause significant damage to the surface of ball 26.

As used in this specification and in the claims, the term "ball" denotes and connotes collectively all types of projectiles including, but not limited to, round balls, musket balls, mini-balls, and bullets.

As shown in FIG. 1, ball 26 is partially wrapped in a greased, cloth patch 28 to facilitate placement of ball 26 in bore 14 and to provide more secure enclosure of ball 26 in the lands 16 and grooves 18 of bore 14. Although bore 14 in FIG. 1 is depicted as a rifled bore containing lands 16 and grooves 18, the concept, apparatus and method of this invention apply equally to smooth bore weapons as well as weapons having rifled bores.

Figure 2:
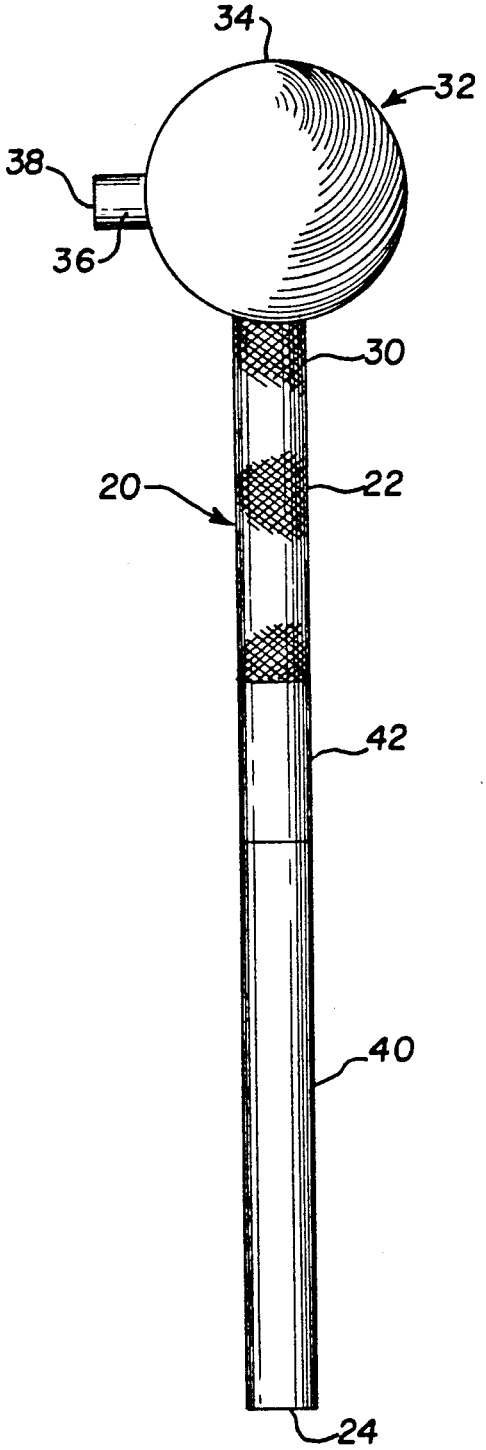
FIG. 2 is a side elevation of the combination weapon tool of this invention and depicting a preferred embodiment of the tool having a tapering body configuration.

As shown in FIGS. 1 and 2, one end 30 of body 22 of tool 20 is connected to a ball starter assembly indicated generally by reference numeral 32, which includes a grip member 34 and a bullet starter 36. Grip member 34 of ball starter assembly 32 is usually substantially spherical in configuration; however, grip member 34 can have any configuration that is preferred and suitable to use of tool 20. Bullet starter 36 extends outwardly from grip member 34. Bullet starter 36 can have any configuration and size suitable for the use of tool 20. Usually bullet starter 36 consists of a cylindrical, solid brass appendage extending outwardly from grip member 34. Within the concept of this invention, bullet starter 36 can be hollow to serve as a whistle signal device. The end of bullet starter 36 distal from grip member 34 has formed thereon a concave end surface 38, constructed and arranged to engage a contiguous surface of a ball without causing significant damage to the soft metal of the ball.

Some of the uses of combination weapon tool 20 can be explained with reference to FIG. 1. The loading of weapon 10 commences with pouring a preselected, measured quantity of gun powder (not shown in the drawing) into bore 14 of barrel 12. As is explained more fully below, various structural members of tool 20 can be used to measure and pour the proper quantity of gun powder for a particular use. After the gun powder is poured, a ball is wrapped in a patch and inserted partially in the opening of bore 14. Ball starter assembly 32 is used by holding grip member 34 and forcing the concave end 38 of bullet starter 36 against the surface of ball 26 to drive ball 26 and patch 28 further into bore 14 of barrel 12. To set ball 26 and patch 28 properly in lands 16 and grooves 18, body member 22 with end surface 24 is used as a land and groove setting rod.

To assure proper placement and packing of the ball and patch in relationship to the powder charge, the optimum procedure involves displacing ball 26 and patch 28 into bore 14 of barrel 12 a distance of approximately 4 to 5 inches using tool 20. Further insertion of ball 26 and patch 28 is accomplished by use of ram rod 17. Consequently, although the overall length of combination weapon tool 20 may be any length found suitable for the needs of a specific weapon, generally the overall length of combination tool 20 will be between 8 and 9 inches, with the length of body member 22 being between 5 and 7 inches. By comparison, bullet starter 36, which is used only to effect initial insertion or placement of ball 26 and patch 28 in bore 14, protrudes from the outer surface of grip member 34 a distance of approximately one-quarter to one-half inch. A longer bullet starter 36 is within the concept of this invention if it is suitable for use with a particular weapon.

Figure 3:
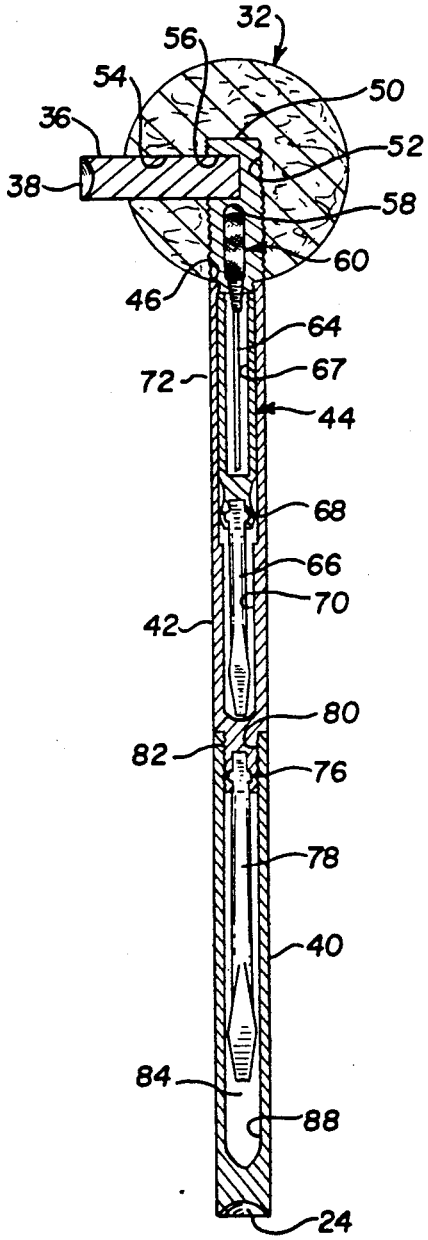
FIG. 3 is a side elevation in longitudinal cross section of the combination weapon tool of this invention.
Figure 4:
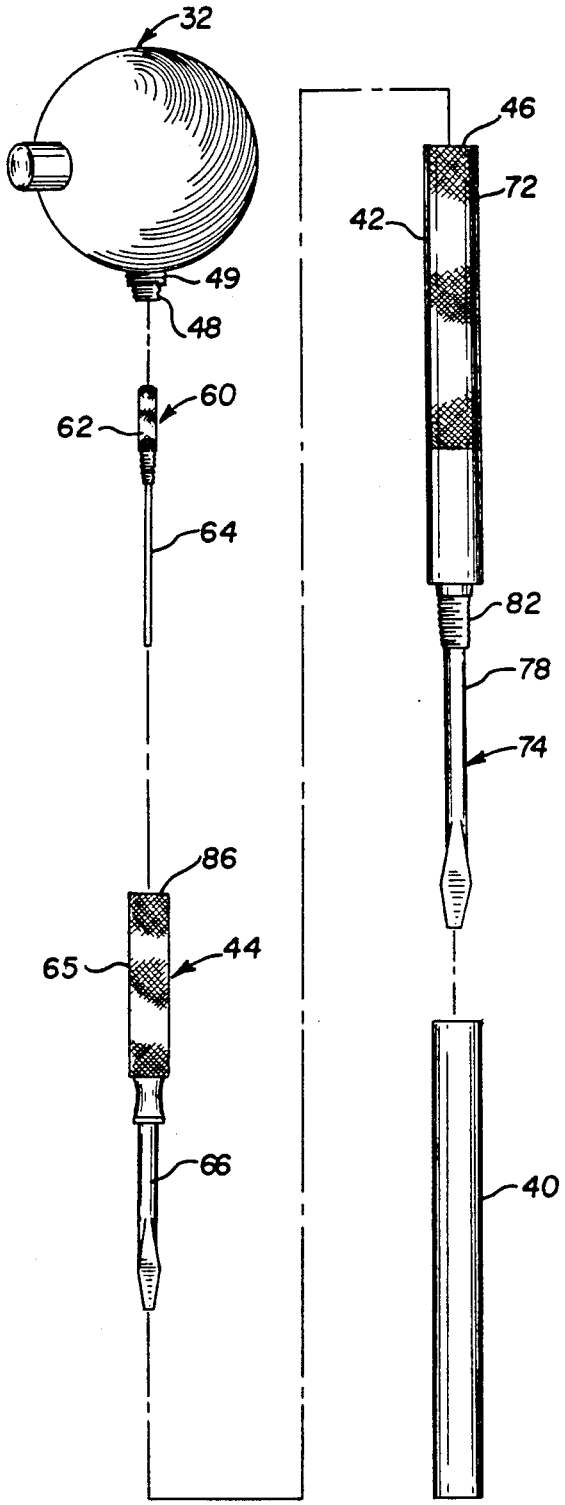
FIG. 4 is an exploded side elevation of the combination weapon tool of this invention depicting individually the separated elements of the tool.

The above described use of combination tool 20 to insert and set a ball and patch involves an additional variation in preferred construction and arrangement of the tool members. In some preferred embodiments of the tool, as shown in FIGS. 1, 3 and 4, the outer diameter of the entire tool body member 22, and the outer diameter of each of the individual, separate body members described more fully below, is cylindrical, non-tapered and of constant transverse cross-section diameter throughout the entire length of the entire body 22 of tool 20 and throughout the length of each separate segment of body 22. In another preferred embodiment of the invention, the overall length of tool body member 22, is tapered, with a uniform degree of taper commencing at the wider end of tool body 22 contiguous to ball starter grip member 34 and the narrower tapered end of body member 22 being located adjacent concave end surface 24, at the end of body member 22 distal from ball starter assembly 32. In another preferred embodiment of this invention, body member 22 consists of a plurality of separate connected body members, shown in FIG. 2 as two separate, connected body members indicated by reference numerals 40 and 42. In the preferred embodiment shown in FIG. 2, the degree of taper is identical for each of the body member portions 40 and 42. In still another preferred embodiment of the invention, the degree of taper may differ between separate, connected body portions 40 and 42. Whether the body 22, and body members 40 and 42 of tool 20 are uniformly cylindrical in transverse cross-section, without any degree of taper along the longitudinal axis, or whether those structural elements are uniformly tapered or constructed and arranged with different degrees of taper, are all elements of structure that are determined by suitability to specific requirements for the tool as related to its use with a specific weapon, and all are within the concept of this invention. Similarly, body member 22 of tool 20 and one or both of body member segments 40 and 42, may be of circular transverse cross-section, or of polygonal transverse cross-section, or of any other curvilinear transverse cross-section, as determined by suitability to the needs of the tool for use with a particular weapon. In such circumstances, all of the transverse cross-section configurations of such body members and segments are within the concept of this invention.

Among the interrelated, multi-purpose functions and uses of tool 20 is the provision of a housing and carrying case and receptacle for a plurality of other tools for use with the weapon and for maintenance and repair of the weapon. Reference to FIGS. 3 and 4 indicates that body member 22 can be constructed of two separate members including an upper body member 42 and a lower body member 40. Upper body member 42 is threadably connected at its upper end 46 to a threaded portion 49 of ball starter connecting member 50, which is enclosed in ball starter grip member 34. In FIG. 3, ball starter connecting member 50 is shown as threaded throughout its length and in threadable engagement with the surfaces of a connecting bore 52 formed in ball starter assembly 32. It is within the concept of this invention that ball starter connecting member 50 can be connected to ball starter grip member 32 by means other than a threaded connection. For example, ball starter connecting member 50 can be secured in ball starter member 32 by a press fit or shrink fit, by bonding with glue or other similar material, or by any other means suitable for a particular use or type of tool 20.

FIG. 3 depicts a second bore, 54, through ball starter grip member 34 which is oriented in axial alignment with a bore 56 in ball starter connecting member 50. Bore 56, as shown, is oriented transversely and normal to the central longitudinal axis of ball starter connecting member 50. That construction and arrangement permits securing bullet starter member 36 within the co-axially aligned bores 54 and 56 in ball starter grip member 34 and ball starter connecting member 50, respectively. Bullet starter member 36 is secured in bores 54 and 56 by any suitable means, including a press fit, shrink fit or close tolerance fit, or by appropriate bonding material (not shown in the drawings), or by threaded connecting means (not shown in the drawings). Any suitable type of connecting means to secure bullet starting member 36 in bores 54 and 56 is within the concept of this invention. The construction and arrangement of bullet starter member 36 within ball starter grip member 34 and ball starter connecting means 50 is adapted to assure that there will be no substantial relative movement between or among the structural members of bullet starter member 36, ball starter grip member 32 or ball starter connecting means 50 when tool 20 is in use.

As shown in FIG. 3, ball starter connecting member 50 has formed therein a central, longitudinal bore 58 extending a portion of the way along the central longitudinal axis of connecting member 50 and opening through the bottom of ball starter connecting threads 48. Bore 58 provides containment housing means and carrying means for one of the weapon repair and maintenance tools included in the combination of this invention; namely, the nipple and flash hole cleaning probe 60 shown in FIG. 3 and 4. Nipple and flash hole cleaning probe 60 comprises a grip member 62 connected by threads, solder or other suitable connecting means to a probe member 64. Grip member 62 is preferably constructed of knurled brass, but can be constructed of any suitable, non-sparking metal, plastic or other material. Preferably, probe member 64 is made of non-sparking, 15 guage, copper wire; however, probe member 64 can be made of any suitable non-sparking material that has sufficient rigidity to displace debris and other materials from the nipple and flash hole without damaging the nipple or flash hole and without substantial destructive deformation to probe member 64.

As shown in FIGS. 3 and 4, two separate sets of threaded connecting means 48 and 49 extend from ball starter grip means 32, with the upper end 46 of upper housing member 42 being threadably connected to threads 49. Threads 48 provide connecting means for connecting to ball starter grip member 34 another tool of the combination of the present invention, a small screwdriver indicated by reference numeral 44. Small screwdriver 44 comprises a hollow grip member 65 which provides a chamber 67 to house and carry nipple and flash tool probe member 60. A small screwdriver blade 66 is connected to grip member 65 by any suitable means, including the connecting means shown in FIG. 3, comprising a pair of stamped lugs 68 formed in the upper end of small screwdriver blade 66 and secured within the surrounding material of grip member 65. Any other suitable means of connecting small screwdriver blade 66 to grip member 65 is within the concept of this invention.

As shown in FIG. 3, the entire small screwdriver assembly 44, is stored, enclosed and carried in a hollow chamber 70, formed by grip member 72 of tool body member 42. Grip member 72 of body member 42 is connected by suitable means at its lower end to a large screwdriver 74. The means connecting large screwdriver 74 to grip member 72 can be any suitable connecting grip means and, in a preferred embodiment, is depicted in FIG. 3, consisting of stamped, outwardly extending lugs 76 on the upper portion of shaft 78 of large screwdriver 74, which lugs 76 are secured within the material of grip member 72 of upper body member 42.

As shown in FIG. 3, lower body member 40 is connected at its upper end by suitable threads 80 to matching threads 82 formed on the upper end of large screwdriver 74. Lower body member 40 is hollow to form therein a chamber 84 which houses, contains and carries the blade member of large screwdriver 74. The bottom 24 of lower body member 40 is formed as a concave portion adapted for non-maring, non-destructive engagement between concave bottom portion 24 and the surface of the ball when using the starter tool to place ball 26 in bore 14 of barrel 12.

Unless specifically indicated otherwise, materials of construction of various structural elements of the apparatus of this invention are not critical to the concept of this invention. For example, grip member 34 of ball starter assembly 32 is, in a preferred embodiment, made of hardwood because of its appearance and durability. However, ball starter grip member 32 can be made of metal or plastic or any other rigid durable material. Similarly, the nipple and flash hole probe, screwdrivers and body members of this invention have been described in preferred embodiments as being constructed of a non-sparking metal, such as brass. Nevertheless, within the concept of this invention, the nipple and flash hole probe, screwdrivers and body members can be made of durable plastic or other durable, non-sparking metals or alloys. Use of non-sparking materials is preferred in the construction of the structural elements of the tool of this invention because the tool is used in close proximity to gun powder.

Other functions of the component structural members of the combination tool of this invention can be explained with reference to FIGS. 3 and 4. Individual powder measures of predetermined volumes are provided by the hollow grip members and body members including lower body member 40, grip member 72 of large screwdriver 74 and grip member 65 of small screwdriver 44. In addition, those individual powder measures can be further graduated or calibrated with externally or internally inscribed lines or other indicia to indicate smaller powder quantities when one of the powder measures is filled only partially with gun powder. A threaded plug (not shown in the drawings) can be mounted in the bottom of lower housing member 40 to facilitate adjustment therein of the available powder volume, or of the whistle pitch, by screwing the bottom plug into or out of hollow chamber 84.

The individual structural elements of the combination tool of this invention provide additional instruments useful to hunters and other sportsmen engaged in the use of the tool. It is highly desirable and useful for hunters, shooters and other sportsmen to have available a whistle or other audible signalling device, whether engaging alone in the sporting activity, or hunting or shooting in groups, to signal a need for assistance, to indicate their respective locations, to signal the taking of various actions such as sighting game, wounding game, felling game, needing assistance to retrieve game, and so forth. It is more useful if each sportsman involved in a group has available or assigned to him, respectively, a whistle or audible signalling device having a preselected, preassigned sonic pitch. In addition, usefulness of the whistle or audible signaling device can be further extended by assigning to each specific combination of short and long soundings of the whistle a specific significance, such as sounding two long emissions on a whistle of specific pitch to indicate which of a group of sportsmen just fired one or more rounds from his or her own weapon.

All of those functions discussed immediately above are served by the audible signaling devices provided by the whistles of this invention. Hollow, whistle signaling devices, each having a different sonic pitch, are provided by lower body member 40, grip member 72 of upper body member 42, grip member 65 of small screwdriver 44, hollow chamber 58 of bullet starter connecting means 50, and bullet starter 36, if it is hollow. It is noted that the whistle signaling functions of those structural members are present regardless of the material from which those members are constructed.

Another function of weapon use, maintenance and repair is served by the tools included in the structural elements of combination tool 20 of this invention. It is occasionally necessary to remove the wedge pin from the weapon for cleaning or repair. That function is achieved by using the blade portion of either the large screwdriver or the small screwdriver. In addition, the top surface and edge 46 of upper body member 42, or the top surface 86 of small screwdriver 44, can be used to remove the wedge pin, or to remove the flash hole bushing or nipple. In addition, small screwdriver 44 can be used to adjust the weapon sights or to remove the flash hole port bushing or nipple.

Additional uses of the structural members of the combination tool 20 of this invention are within the concept of this invention but not specifically shown in the drawings. The lower hollow portion shown as portion 88 in FIG. 3 of lower body member 40 can be used to store flash hole bushing and nipple inserts or other small items. In addition, appropriate receptacles or chambers, and caps or covers for those receptacles or chambers, can be formed in ball starter grip member 32 for storage of flints, patches, caps, and other small items.

According to the provisions of the patent statues, I have explained the principle, preferred construction and mode of operation of my invention and have illustrated and described what I now consider to represent its best embodiments. However, it should be understood that within the scope of the appended claims, the invention may be practiced otherwise than as specifically illustrated and described.

Therefore I claim:

1. Combination tool apparatus for use with a muzzle loading weapon, said apparatus comprising An elongated body member constructed and arranged to facilitate translational movement within a hollow barrel of said weapon, and Ball starter means connected to one end of said body member, and Said body member being constructed and arranged to provide a land and groove setting rod on said tool apparatus, and Said body member being closed at its end distal from said ball starting means, and Said body member having formed therein a plurality of chambers, each of said chambers being constructed and arranged to contain at least one of a plurality of tools adapted for use with said weapon.

2. Apparatus as described in claim 1 wherein said body member comprises a plurality of separate body members connected serially, in mutual co-axial alignment with a central, longitudinal axis of said body member.

3. Apparatus as described in claim 1 wherein said plurality of tools adapted for use with said weapon includes at least one screwdriver apparatus.

4. Apparatus as described in claim 1 wherein said plurality of tools adapted for use with said weapon includes a cleaning apparatus for the weapon flash hole and nipple.

5. Apparatus as described in claim 1 wherein at least one of said body members is constructed and arranged to provide a signal whistle.

6. Apparatus as described in claim 2 wherein each of said separate body members is constructed and arranged to provide a signal whistle having a sonic pitch discernably different from the pitch of each of the other of said body members.

7. Apparatus as described in claim 1 wherein said ball starter means is connected to the body member by hollow connecting means constructed and arranged to provide a signal whistle.

8. Apparatus as described in claim 2 wherein said separate body members contain collectively a combination of a plurality of screwdrivers and a cleaning probe for a flash hole and nipple.

9. Apparatus as described in claim 2 wherein at least one of said body members is constructed and arranged to provide a powder measure.

10. Apparatus as described in claim 2 wherein each of said body members is constructed and arranged for selective use as a powder measure and wherein each of said powder measures is constructed to provide a preselected amount of powder.

11. Apparatus as described in claim 1 wherein the outer surface of the body member tapers inwardly toward the central longitudinal axis of said body member from the portion of the body member adjacent the ball starter means toward the end of the body member distal from the ball starter means.

12. Apparatus as described in claim 2, wherein each of said separate body members tapers inwardly toward the central longitudinal axis of said body member from the end of said body member proximate to said ball starter means toward the end of said body member distal from said ball starter means.

13. Apparatus as described in claim 1, wherein said ball starter means comprise a substantially spherical grip member and a bullet starter extension having one end extending outwardly from said grip member and the other end secured within said grip member.

14. Apparatus as described in claim 13, wherein said bullet starter extension and said body member distal from said ball starter means each have formed in the end thereof a concave surface adapted to engage the surface of a ball without significant damage to said ball surface.

* * * * *